73-151
11/24/87 XR 4,708,204

United States Patent [19]

Stroud

[11] Patent Number: 4,708,204

[45] Date of Patent: Nov. 24, 1987

[54] SYSTEM FOR DETERMINING THE FREE POINT OF PIPE STUCK IN A BOREHOLE

[75] Inventor: Stanley G. Stroud, Houston, Tex.

[73] Assignee: NL Industries, Inc., New York, N.Y.

[21] Appl. No.: 912,698

[22] Filed: Sep. 29, 1986

Related U.S. Application Data

[63] Continuation of Ser. No. 607,281, May 4, 1984, abandoned.

[51] Int. Cl.[4] ..... E21B 47/00

[52] U.S. Cl. ..... 166/255; 166/65.1; 73/151

[58] Field of Search ..... 166/65.1, 255, 250; 73/151

[56] References Cited

U.S. PATENT DOCUMENTS

| | | | |
|---|---|---|---|
| 2,686,039 | 8/1954 | Bender | 166/250 |
| 2,814,019 | 11/1957 | Bender | 166/250 |
| 3,095,736 | 7/1963 | Rogers | 73/151 |
| 3,690,163 | 9/1972 | Shannon et al. | 73/151 |
| 3,942,373 | 3/1976 | Rogers | 166/255 |
| 4,289,024 | 9/1981 | Basham et al. | 73/151 |
| 4,351,186 | 9/1982 | Moulin | 73/151 |
| 4,402,219 | 9/1983 | Hache | 73/151 |
| 4,444,050 | 4/1984 | Revetz | 73/151 |
| 4,515,010 | 5/1985 | Weido et al. | 166/255 |

*Primary Examiner*—Stephen J. Novosad
*Assistant Examiner*—William P. Neuder
*Attorney, Agent, or Firm*—Browning, Bushman, Zamecki & Anderson

[57] ABSTRACT

A system for determining the stuck point of pipe in a borehole including a wireline tool having an exciter coil and a receiver coil axially spaced from one another. The exciter coil is driven at a preselected low frequency and the voltage induced into the receiver coil is related to the magnetic permeability of a pipe through which the tool is run. A receiver coil voltage log is run of the section of pipe in the region of the stuck point first while that region is substantially free of mechanical stress. A second log of the same region is run with the pipe under mechanical stress. Comparison of the two logs determines the stuck point from the difference in magnetic permeability of the stressed pipe above the stuck point and the unstressed pipe below the stuck point.

24 Claims, 10 Drawing Figures

SYSTEM FOR DETERMINING THE FREE POINT OF PIPE STUCK IN A BOREHOLE

This is a continuation of co-pending application Ser. No. 607,281 filed on May 4, 1984 now abandoned.

BACKGROUND OF THE INVENTION

1. Field of the Invention

The invention relates to a method and apparatus for determining the point at which a pipe is stuck in a borehole and, more particularly, to a system for magnetically determining a pipe's free point location without the necessity of attaching apparatus to the pipe wall.

2. History of the Prior Art

In the drilling of oil and gas wells through earth formations it often occurs that the drilling pipe will become stuck in the borehole being formed. This may happen because of a collapse or cave-in of the subterranean formation surrounding the borehole. It may also occur as a result of fluid absorption and swelling of certain downhole formations which restrict the movement of the drilling pipe within the borehole, as well as for many other reasons. When this phenomenon does occur, the drilling pipe becomes jammed, operation ceases and no further progress can be made in deepening of the borehole until the stuck pipe is removed.

The first step in clearing a jammed pipe in a borehole is locating the point along the borehole, often several thousand feet beneath the surface, at which the pipe is stuck. Numerous techniques have been developed over the years for locating the free point of the pipe in the borehole so that the pipe portion above the stuck region can be removed. The most popular technique involves the lowering of a tool down the central passageway of the drilling pipe and the attachment of a pair of relatively movable sensor members to the inside pipe wall. The drill pipe is then stretched either longitudinally or in torsion so that any relative movement between the two fixed members indicates that the members are fixed to the pipe wall at a location above the stuck point. Of course, stresses in the drill string which are induced from the surface are only reflected in that portion of the drill string which is above the stuck point. As soon as the sensor pair is affixed to the walls of the pipe below the stuck point and the drill string is stressed, there will be no relative movement between the two members. Thus, by sequential measurement and movement of the sensors along the inside of the drill pipe, the stuck point is located. Systems of this type are, however, relatively slow in that the sequential attachment and detachment of the sensor members requires time and time in the operation of a drilling rig is very expensive. In addition, the contacting type of stuck pipe detectors also require elaborate mechanical or magnetic means for attaching the sensor members to the wall of the pipe.

A known characteristic of ferromagnetic pipe is that the magnetic permeability of the material changes as a function of stresses in the material. Another prior art stuck point detector system has utilized this principle rather than the mechanical elongation of the pipe. Employment of this technique allows the construction and use of a non-contacting stuck point detector which does not need to engage the sidewalls of the pipe. As shown in U.S. Pat. No. 2,686,039 to Bender, a high frequency oscillator 10 is tuned to a frequency on the order of 20 to 50 $KH_z$ by a coil 12 and lowered into the axial bore of a stuck drill pipe. The coil is inductively coupled to the wall of the steel pipe which loads the coil and is thus a part of the tuned tank circuit of the oscillator 10. The magnetic permeability of the pipe determines the degree of loading of the coil 12, therefore, the inductance of the tank circuit and the frequency of the oscillator. As the coil passes the stuck point of a drill pipe under stress, the oscillator will shift in frequency due to the fact that the magnetic permeability of the unstressed pipe below the point is different from that of the stressed pipe above the stuck point. While the Bender system is capable of detecting the stuck point without physical attachment of sensors to the pipe walls such a system includes a number of inherent disadvantages. Perhaps the greatest of these is that the inductive coupling of the pipe into an oscillator tank circuit requires the use of relatively high frequencies. The depth of penetration of high frequency electromagnetic waves are limited by skin effect and thus, the overall accuracy and reliability of the technique is limited. The sensitivity of the Bender system is also restricted by the teaching of a single logging run to detect stuck point which does not allow sufficient tolerance for magnetic permeability variance between different pipe materials and sizes.

While certain other prior art tools have included means for measuring the permeability of pipe or tubing, these are generally utilized only in caliper tools for determining thicknesses and inside diameter of unstressed pipe. For example, U.K. Pat. application No. 2,037,439 of Schlumberger Limited, and U.S. Pat. No. 2,992,390 issued to DeWitte both utilize various aspects of magnetic permeability for pipe measurements.

For example, in the Schlumberger U.K. application, there is described a tool for measuring the wall thickness of a well casing by means of magnetic flux. Three pairs of transmitter and receiver coils are employed, one for measuring inside diameter, one for measuring casing thickness and one for measuring casing wall permeability. Variations in each of these parameters affect one another so that measurements of all three simultaneously can be used to correct one another and produce a highly accurate thickness measurement. While the Schlumberger U.K. application discloses a two coil, two log approach to magnetic permeability measurement, it is only disclosed in connection with a caliper tool and none of these proposals have culminated in a commercially satisfactory stuck point detector.

Although the prior art is replete with both method and apparatus for downhole measurement of pipe permeability, the problem of accurately locating stuck pipe in a borehole has still existed. The system of the present invention has overcome the disadvantages of the prior art to produce a highly successful tool by providing a non-contacting magnetic stuck point detector which uses relatively low frequency to detect changes in permeability occurring in stressed pipe within a borehole. In this manner, an effective system and method is provided for locating the point along the borehole at which a drill pipe section is lodged.

SUMMARY OF THE INVENTION

The invention comprises a system for determining the stuck point of a pipe within a borehole by providing a pair of coils located on a common axis and spaced apart a prescribed distance. The exciter coil is energized at a relatively low preselected frequency while the coils are lowered into the drilling pipe when the pipe is in a generally unstressed condition. A log of the output of the receiver coil is taken. Thereafter, the sidewalls of the pipe are placed in stress and the process repeated to take a second log. A comparison of the two logs is made to give an indication of the location of the stuck point within the borehole due to the change in signal received by the coil. The signal change is a result of magnetic permeability shift between the stressed and unstressed conditions of the drill pipe above and below the stuck point.

In another aspect, the invention includes an improved method for detecting the stuck point location of drilling pipe lodged within a borehole of the type wherein a tool is lowered through ferromagnetic pipe sections for detecting permeability changes therein. The improvement comprises the steps of providing a wire line tool having a pair of spaced apart coils adapted for descent within the drilling pipe to sense the permeability of the pipe. An alternating frequency primary magnetic flux is generated with one of the coils of the tool and induced into the walls of the drill pipe. The secondary flux signal generated by eddy currents induced in the drill pipe is detected by the receiving coil of the tool as an indicia of permeability. The tool is moved along the drill pipe within the borehole, with the pipe in an unstressed condition, for generating a first log of pipe permeability. The tool is then moved along the drill pipe within the borehole, with the pipe in a stressed condition, for generating a second log of pipe permeability. The first and second logs are then compared to locate the variation in permeability indicative of the stuck point of the pipe within the borehole.

In yet another aspect, the aforesaid method of generating of the first log includes the step of estimating the depth within the borehole of the stuck point, calculating the approximate weight of drill pipe above the stuck point, and applying an upward force to the drill string within the borehole to substantially remove compression forces from the drill pipe in the region of the stuck point. The step of generating the second log then includes the step of applying a compression force to the drill string within the borehole to increase the stress within the drill pipe section in the region of the stuck point. The step of generating the second log may also include the step of applying a torsional load to the drill string within the borehole for imparting a high torsional stress to the drill pipe section in the region of the stuck point. The method may also include the step of separating the first and second coils within the tool a distance from one another by a prescribed distance on the order of six inches and exciting the first coil at a frequency on the order of 130 $H_z$.

BRIEF DESCRIPTION OF THE DRAWING

For a more complete understanding of the present invention and for further objects and advantages thereof, reference may now be had to the following description taken in conjunction with the accompanying drawing, in which:

FIGS. 2A–2F are sequential, enlarged, partially side elevational and partially longitudinal cross-sectional views of a stuck point detection tool constructed in accordance with principles of the present invention;

DETAILED DESCRIPTION OF THE PREFERRED EMBODIMENT

Figure 1:
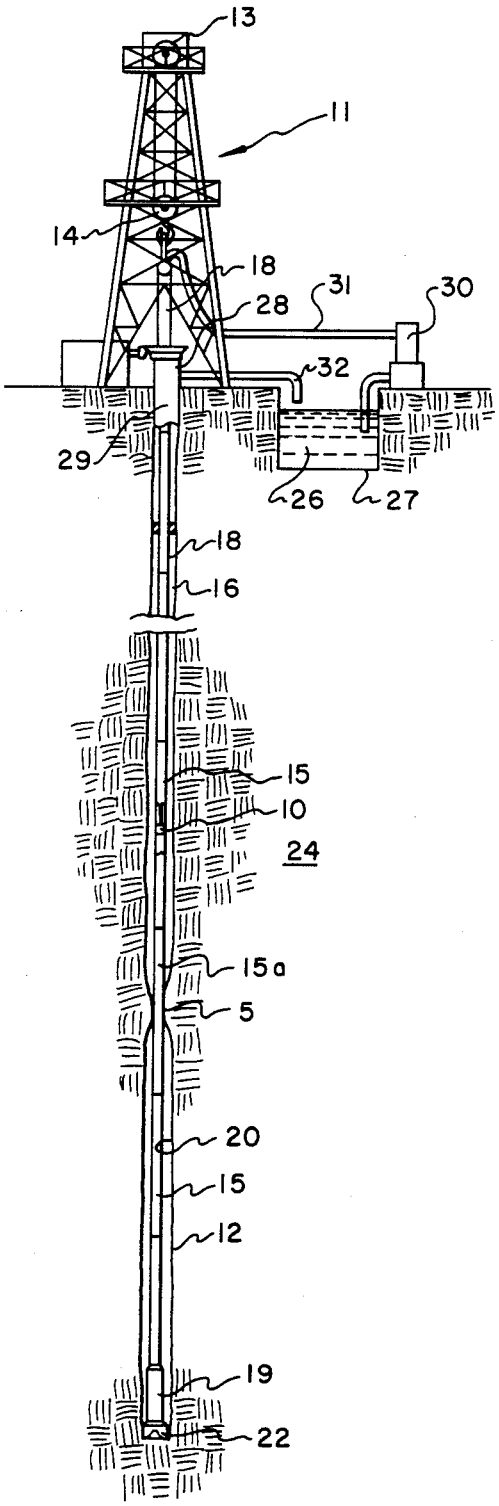
FIG. 1 is a side elevational partially cross-sectional view of a drilling rig forming a borehole.

Referring first to FIG. 1, there is shown a drilling rig 11 disposed atop a borehole 12. The rig 11 includes draw works having a crown block 13 mounted atop the rig and a traveling block 14 which is hooked to the upper end of a drill string 18. The drill string 18 consists of a plurality of series connected sections of drilling pipe 15 which are threaded end to end in a conventional fashion. A drilling bit 22 is located at the lower end of the drilling string 18 by a drill collar 19. The drilling bit 22 serves to carve the borehole 12 through the earth formations 24. Drilling mud 26 is pumped from a storage reservoir pit 27 near the wellhead 28 down an axial passageway through the center of each of the drill pipes 15 comprising the drill string 18, out of apertures in the bit 22 and back to the surface through the annular region 16. Metal casing 29 is shown positioned in the borehole 12 near the surface for maintaining the integrity of the upper portion of the borehole 12.

Still referring to FIG. 1, the annulus 16 between the drill stem 18 and the side walls 20 of the borehole 12 form the return flow path for the drilling mud. Mud is pumped from the storage pit 26 near the wellhead 28 by pumping system 30. The mud travels through a mud supply line 31 which is coupled to the central passageway extending through the length of the drilling string 18. Drilling mud is, in this manner, forced down through the string 18 and exits into the borehole through apertures in the drill bit 22 for cooling and lubricating the drill bit and carrying the formation cuttings produced during the drilling operation back to the surface. A fluid exhaust conduit 32 is connected from the annular passageway 16 at the wellhead for conducting the return mud flow from the borehole 12 to the mud pit 26.

As is also illustrated in FIG. 1, a cave-in of the walls of the borehole can occur around the drilling stem 18 so that the pipe section **15*a* is stuck in the hole as illustrated at point S. The system of the invention functions to locate this point S along the length of the borehole 12 and drilling stem 18 at a measured distance from the wellhead so that all of the free sections of drill pipe 15 above pipe joint 15*a*, which is immovably jammed in the borehole 12, can be removed. Once all of the pipe above the freepoint S is removed equipment can be brought into the borehole 12 to unstick joint 15*a*** and thereafter resume the drilling operation.

It should be understood that the system of the present invention includes a wireline tool which is lowered down through the central bore formed in each of the sections of drill pipe by means not shown. The necessary wireline trucks, guide pulleys and the like are positioned over the borehole at the well head in a conventional fashion to operate the tool while still controlling the weight on the bit 22 and drill string 18 by means of the crown and travelling blocks 13 and 14.

Still referring to FIG. 1, a tool 10 constructed in accordance with the principles of the present invention, is lowered into the borehole 12 through the central passageway in the drill string 18 by means of a wireline (not shown). The wireline is conventional and consists of an armored coaxial two conductor cable which provides both a mechanical and electrical connection between the tool 10 and the wireline control and monitoring equipment at the surface. The tool 10 descends down through the central aperture in the drilling string 18 from the wellhead in order to locate the stuck point S through measurable changes in the physical characteristics of the pipe related thereto.

It is well known that when a ferromagnetic member such as a drill pipe is stretched, compressed or torqued the magnetic permeability of the material changes. Further, if a magnetic field is induced into the walls of drill pipe, eddy currents will be generated in the drill pipe wall. The pattern and strength of the eddy currents will be related to the permeability of the material comprising the pipe. The preferred way to measure the permeability related eddy currents in a drill pipe is by using a receiving coil to detect the electromagnetic fields produced by those eddy currents in the pipe material. In general, the measurement parameters are defined by the classical eddy current equation:

$$B = B_o e^{-2\pi d\sqrt{\frac{f\mu}{\rho\times 10^3}}} \sin\left(2\pi ft - 2\pi d\sqrt{\frac{f\mu}{\rho\times 10^3}}\right)$$

The above equation defines equates magnetic flux density B, at a depth d, within the material when:

$B_o$=magnetic flux density of the surface;
d=depth in centimeters;
f=frequency in $H_z$;
$\mu$=magnetic permebility;
$\rho$=centimeters; and
t=time in seconds.

The amplitude variation of magnetic flux density with depth into the material is:

$$\text{Amplitude } B = B_o e^{-2\pi d\sqrt{\frac{f\mu}{\rho\times 10^3}}}$$

Phase shift with depth d is indicated by the following equation:

$$\phi = 2\pi d\sqrt{\frac{f\mu}{\rho\times 10^3}}$$

Magnetic flux induced into the drill pipe by an input signal will thus produce eddy currents which will in turn create an electromagnetic field. This secondary magnetic field produced by eddy current flow in the pipe may be detected by a receiving coil. If the input signal as well as all other variables are held constant then the signal on the receiving coil will vary in amplitude and phase as a function of the magnetic permeability of the pipe.

Referring still to FIG. 1, the method of the present invention incorporates several steps for enhancing accuracy and reliability of the critical downhole measurements. A driller faced with a stuck pipe will utilize the system 10 by approximating the depth within the borehole 12 at which the pipe is stuck. This may be accomplished by pulling the drill string upwardly by means of the crown block and travelling blocks 13 and 14 with a preselected quantity of force. For example, 20,000 pounds upward force will produce a measurable degree of elongation in the drill string 15. Knowing the degree to which steel drill pipe of a known type elongates under a preselected force, the operator can then estimate the length from the surface to the stuck point S over which the stretching of the pipe is occurring. In this manner the approximate location of the stuck point S of the drill pipe 15 may be estimated within an accuracy of a few hundred feet. The approximate length of pipe between the well head and the downhole stuck point S permits calculation of the weight of that pipe down to that depth and the amount of upward force necessary to substantially remove the weight of the pipe from the section 15*a* lodged at the stuck point. This creates a generally zero stress condition within the pipe section 15*a* in the region of the stuck point S.

When the pipe section 15*a* in the region of the stuck point S is supported in a generally zero stress condition, a first log of drill pipe permeability is taken. This log records the permeability of the drill string along the approximate region where the pipe is believed to be stuck. Thereafter, the driller places a preselected degree of stress on the pipe in the region of the stuck point. Stress in the drill string 18 in the region of the section 15*a* may be created by either placing the pipe in a high degree of tension through pulling on the string, by placing the pipe in compression by releasing the weight of the drill string onto the region or by applying torsion to the drill string through twisting.

When the drill string 18 in the region of section 15*a* and stuck point S is in a mechanically stressed condition, a second drill pipe permeability log is run by means of the system 10. The stressed log is then compared to the unstressed log of the same region. The comparison clearly indicates the downhole point at which the stress on the drill string is suddenly relieved, that is, the point below the stuck point S. The tool 10 used in conjunction with the system of the present invention may also incorporate means near its lower end for mounting a string shot, chemical cutter or the like for loosening or severing of the drill pipe immediately above section 15*a* and the stuck point S so that the drill string in the upper portion of the borehole can be removed.

Figure 2A:
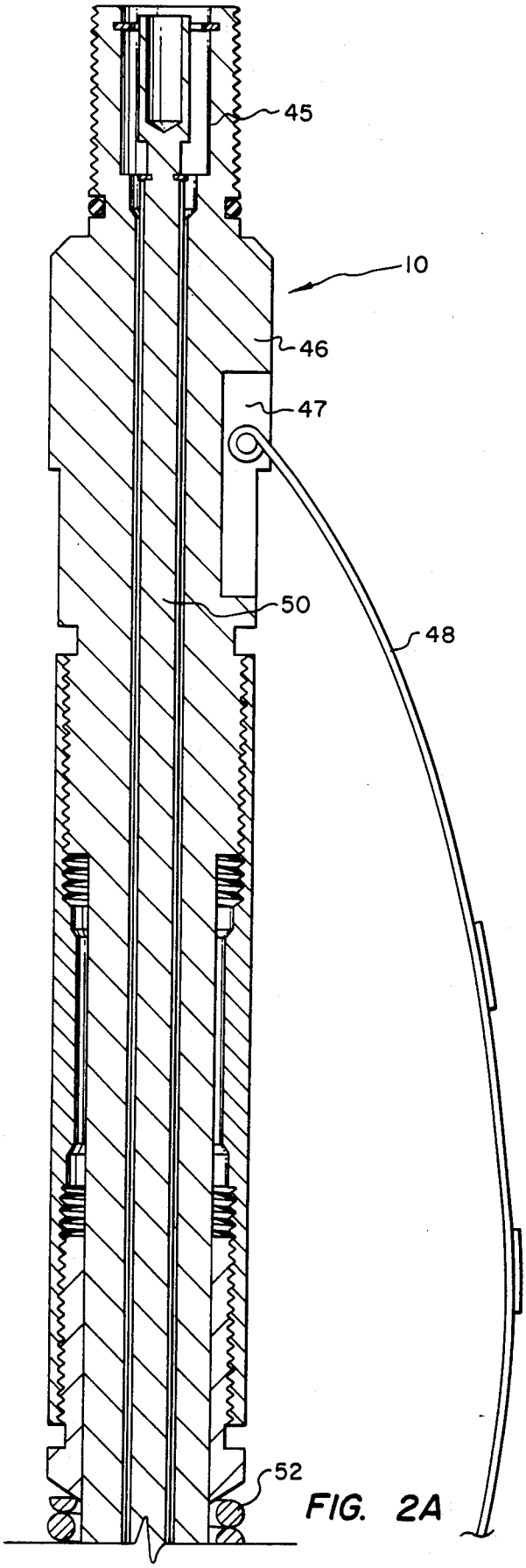
Figure 2B:
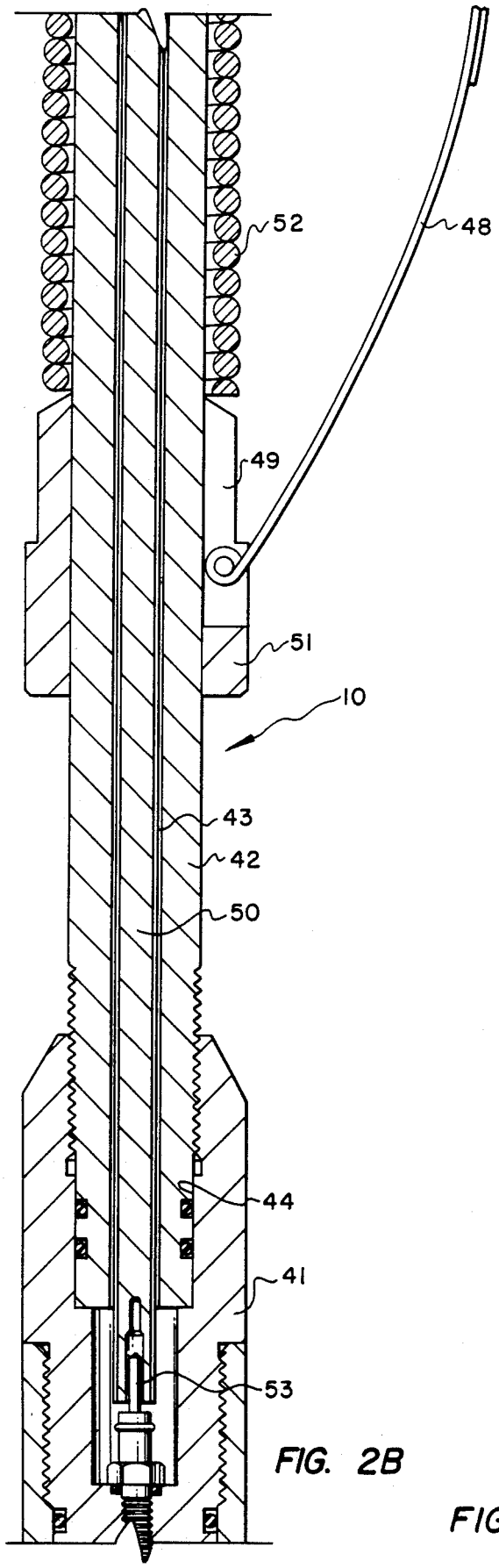
Figure 2C:
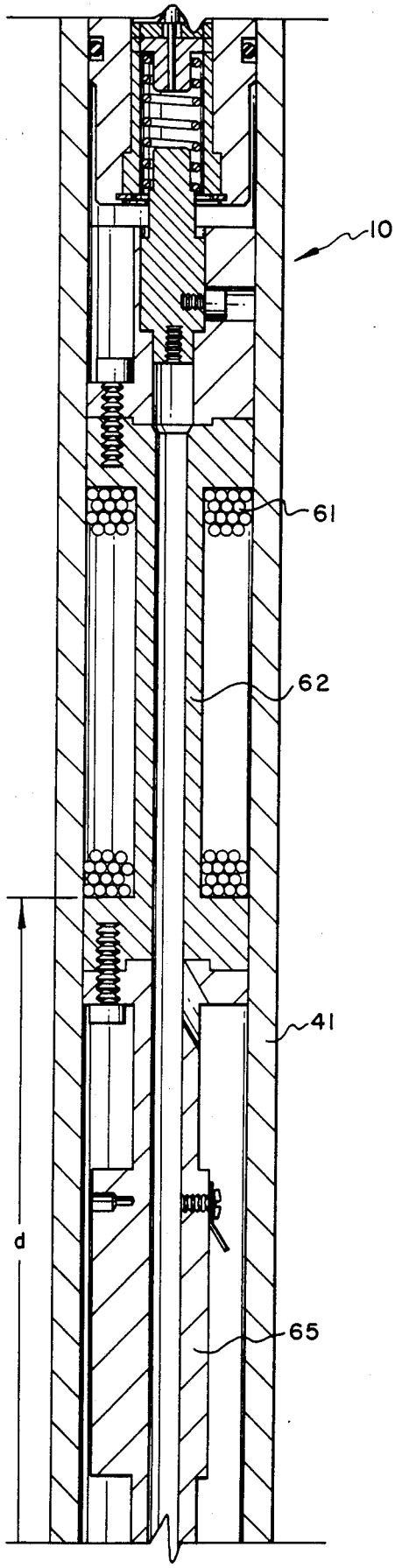
Figure 2D:
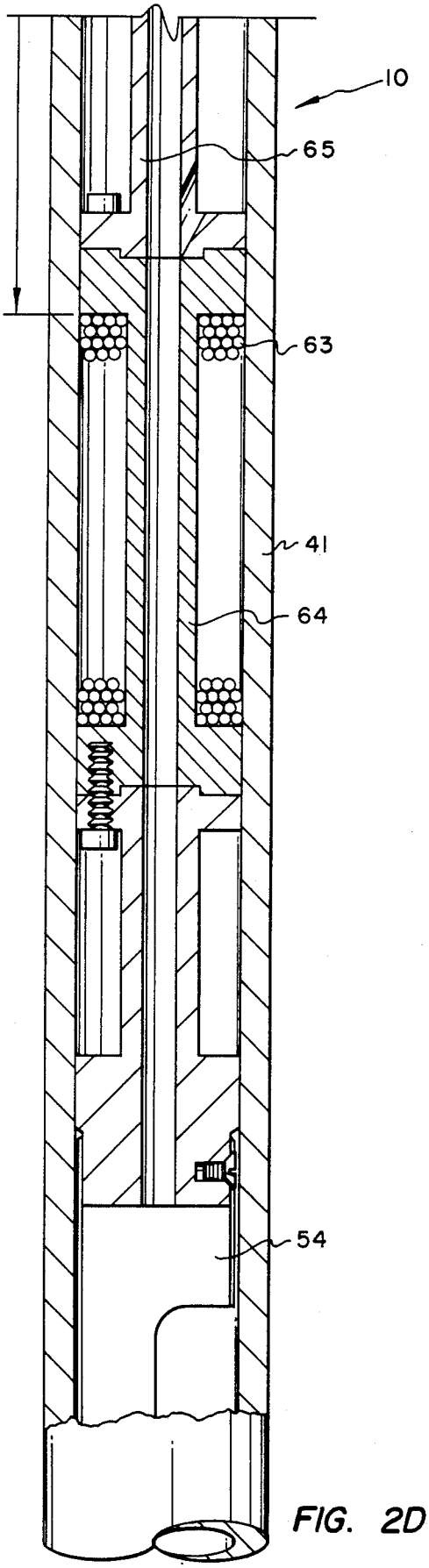
Figure 2E:
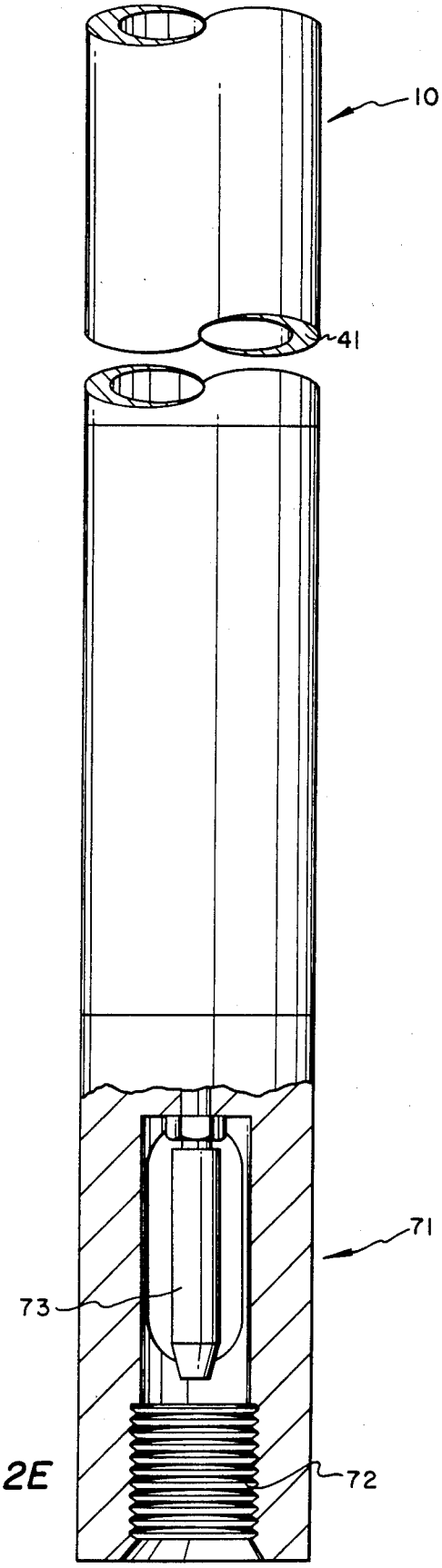

Referring now to FIGS. 2A–2E, there are shown a series of longitudinal cross-sectional views of a tool 10 constructed in accordance with the principles of the present invention. Referring first to FIGS. 2C–2E there is shown a portion of the instrument housing portion of the tool 10 which comprises an outer cylindrical housing or shell 41 formed of non-magnetic material such as non-magnetic stainless steel alloy. The outer housing walls are relatively thick so as to protect the internal coils and electronics of the tool 10. The housing 41 is also constructed to resist the shocks produced by explosive charges of the type used to uncouple drill pipe joints within the borehole 12 once the stuck point S has been located. As shown in FIG. 2B, the upper end of the cylindrical housing 41 is coupled to a cylindrical shaft 42 having a central aperture 43 formed therethrough. The central shaft 42 is threadedly received into a socket 44 in the upper end of tool housing 41. As shown in FIG. 2A, the upper end of the shaft 42 includes a mechanical and electrical connecting socket portion 45 for receiving and coupling to the lower end of a coaxial wireline (not shown) used to lower the tool 10 into the central aperture of the drill pipe and provide communication between the tool and the requisite power supply and control equipment at the surface.

Adjacent the socket portion 45 is an upper spring guide portion 46 having plurality of azimuthally spaced guide slots 47 formed therein which receive one end of a centralizing spring 48. As shown in FIG. 2B, the other end of the centralizing spring 48 is mounted in a lower guide slot 49 of a lower bushing 51. There are, preferably, three centralizing springs 48 spaced at 120 degrees around the axis of the tool. A helical spring assembly 52 insures that the three centralizing springs 48 center the axis of the tool 10 within the central axis of the drill pipe aperture.

Referring to the portion of the tool 10 shown in FIGS. 2A and 2B the central aperture 43 carries a coaxial conductor 50 which is electrically insulated from the sidewalls of the central aperture 43 and carries electrical power and signals from the central conductor of the coaxial wireline to the instrument portion of the tool through a connector assembly 53. The conductor 50 is connected between the wireline and electronic circuitry within housing 54 (FIG. 2D) where DC power from the surface is delivered to the electronics of the tool 10 and from which an AC voltage data signal is passed back up the wireline to the surface.

As shown in FIGS. 2C and 2D the non-magnetic outer shell 41 of the tool 10 houses an exciter coil 61 comprising multiple turns of wire wound about a core 62 formed of a magnetic material. A receiver coil 63 is spaced a preselected distance "d" from the exciter coil 61 and also comprises a plurality of turns of wire wound circumferentially about an insulative coil core 64. The two coils 61 and 63 are spaced from one another the preselected distance by a coil spacer 65 which is affixed to the opposing flanged ends of the respective coil cores 62 and 64. The electronics positioned within the chamber 54 comprises circuitry which will be described below for use in connection with generating the excitation signal and measuring a received signal in accordance with the teachings of the present invention.

The lower portion of the tool 71 shown in FIG. 2E includes means 72 for attaching the lower end to an explosive charge or a chemical cutter as is required for the particular downhole condition. Additionally, the lower end 71 provides a connector 73 for coupling a signal from the wireline to the surface to detonate the explosive charge or to activate the chemical cutter. This action is necessary to separate the lodged drill pipe 15*a* in the vicinity of the stuck points from the rest of the drilling string above it so that the string can be removed. Thus, the stuck portion of the string may be properly handled for removal or bypass in accordance with known techniques.

Figure 3:
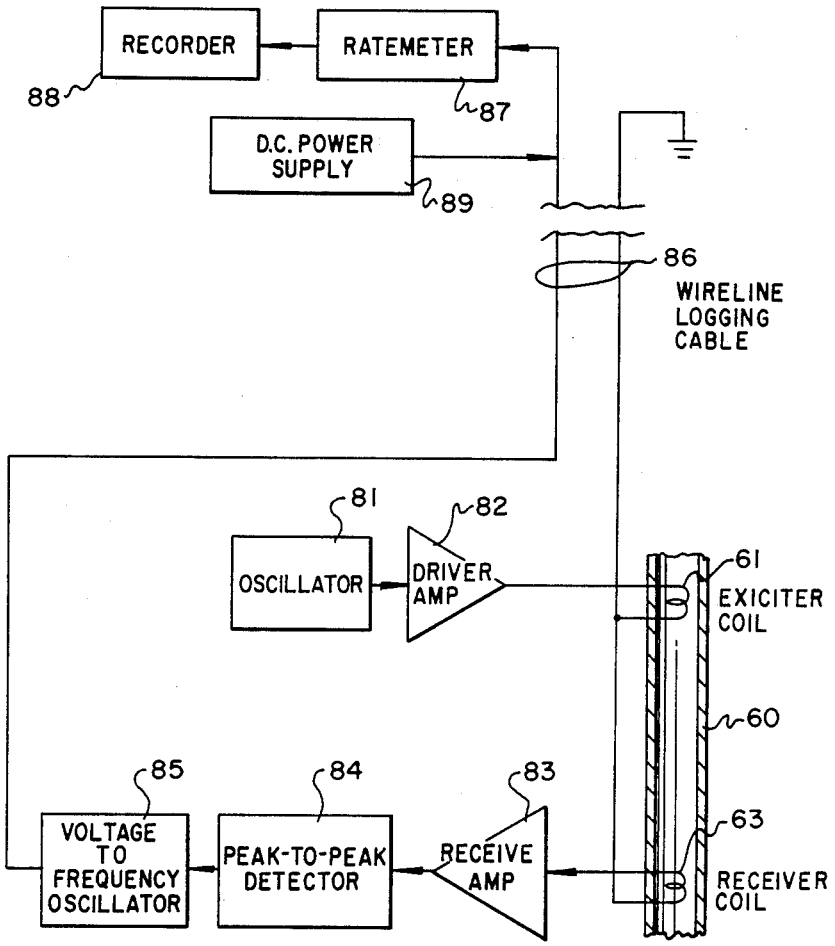
FIG. 3 is block diagram of the system of the present invention.

Referring now to the block diagram of FIG. 3 there is shown the manner of operation of the overall system. As illustrated, the exciter coil 61 is driven by an oscillator 81 through a drive amplifier 82 to generate an AC variation in magnetic flux. This flux variation is used to produce eddy currents in the wall of the drilling pipe schematically and illustratively shown as 15. The receiver coil 63 has a voltage induced therein by the magnetic flux in the pipe wall to which it is exposed because of the flowing eddy currents. The output from the receiver coil 63 is connected through a receiver amplifier 83 to a peak detector 84 which measures the peak-to-peak voltage of the output of the amplifier 83. The output of the peak detector 84 is coupled through a voltage to frequency converter 85 which produces a series of output pulses. The frequency of the pulses from the voltage controlled oscillator contained within the voltage-to-frequency converter 85 is controlled by the value of the signal from the peak detector 84. The output signal from the converter 85 is passed back up the wireline 86 to the surface where it is fed into a rate meter 87. A signal indicative of the downhole frequency is generated by rate meter 87 and logged as a function of tool position by recorder 88. A DC power supply 89 feeds a DC voltage down the wireline 86 to power the electronics and drive the exciter coil 61 and receive the signal from the pick-up coil 63. The recorder 88 may be of the conventional strip chart recorder type for generating logs of pipe magnetic permeability as a function of position of the wireline tool along the borehole. Thus, mechanical graphs may be produced for comparison. Alternatively, recorder 88 may include data storage and processing means which records, analyzes and compares sequential logging runs to give a direct output of variations therebetween.

In the method and apparatus of the present invention it has been found that there are several significant parameters which must be met with regard to the successful operation of the system. For example, the frequency with which the exciter coil 61 is driven is important for maximum sensitivity and accurate measurement of magnetic permeability downhole. It has also been found that the spacing d between the exciter and receiver coils, 61 and 63, is particularly significant and is also related to the excitation frequency at which maximum sensitivity to permeability changes in the steel drill pipe is present in the system.

Figure 4:
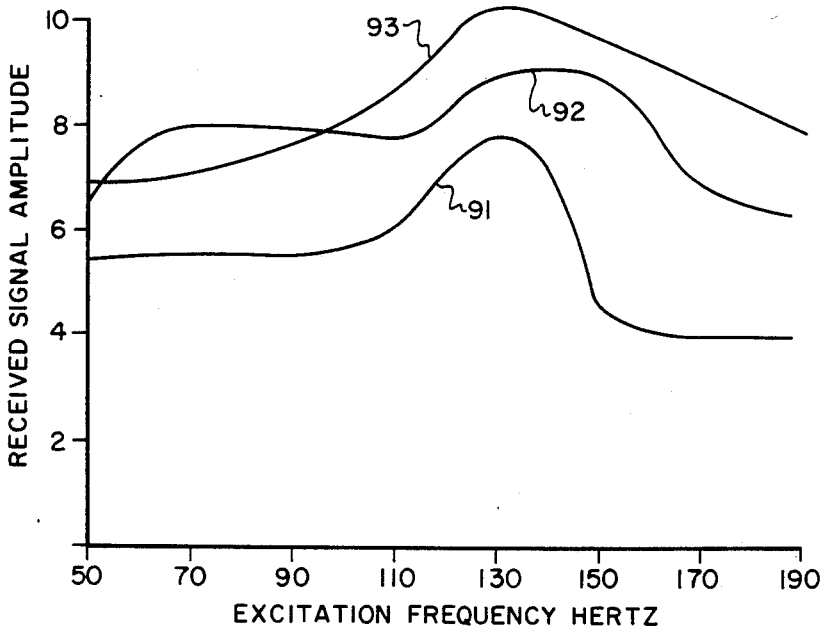
FIG. 4 is a series of graphs of receiver coil output voltages as a function of spacing between the coils within the tool of FIG. 2 and the excitation frequency.

Referring now to FIG. 4, there is shown a series of three superimposed graphs of output voltage for a constant input as a function of frequency of excitation for each of three different distances between the exciter and receiver coils 61 and 63, respectively. The lower curve 91 shows normalized received voltage values for a spacing of about 5 inches between the opposing ends of the exciting and receiving coils 61 and 63. The peak sensitivity for this spacing occurs at a frequency on the order of 130 $H_z$. Similarly, curve 92 shows receiver coil voltage for a spacing of about 7 inches between the coils with a similar peak sensitivity occurring in the range of 130–150 $H_z$. The upper curve 93 shows that maximum receiver voltage sensitivity is obtained at a spacing of about 6 inches between the excitation and receiver coils and at frequency on the order of 130 $H_z$. Thus, it can be seen that an operating excitation frequency on the order of 130 $H_z$ and a spacing of approximately 6 inches between the excitation and receiving coils yields optimum results with respect to obtaining the maximum sensitivity for the detection of a change in magnetic permeability of a ferromagnetic pipe as a function of stress therein.

As was generally discussed above, the system of the present invention, as illustrated in the circuitry shown in FIG. 3, could also be provided with a phase detector on the output of the amplifier 83 rather than the amplitude detector 84. A phase detector would, of course, require connection to the output of amplifier 82 as a reference phase in order to detect the phase shift of the signal on the receiver coil 63 with respect to the driving signal on the exciter coil 61. Phase shift could be used to detect the magnetic permeability change in a stressed pipe across the region of a stuck point.

Figure 5A:
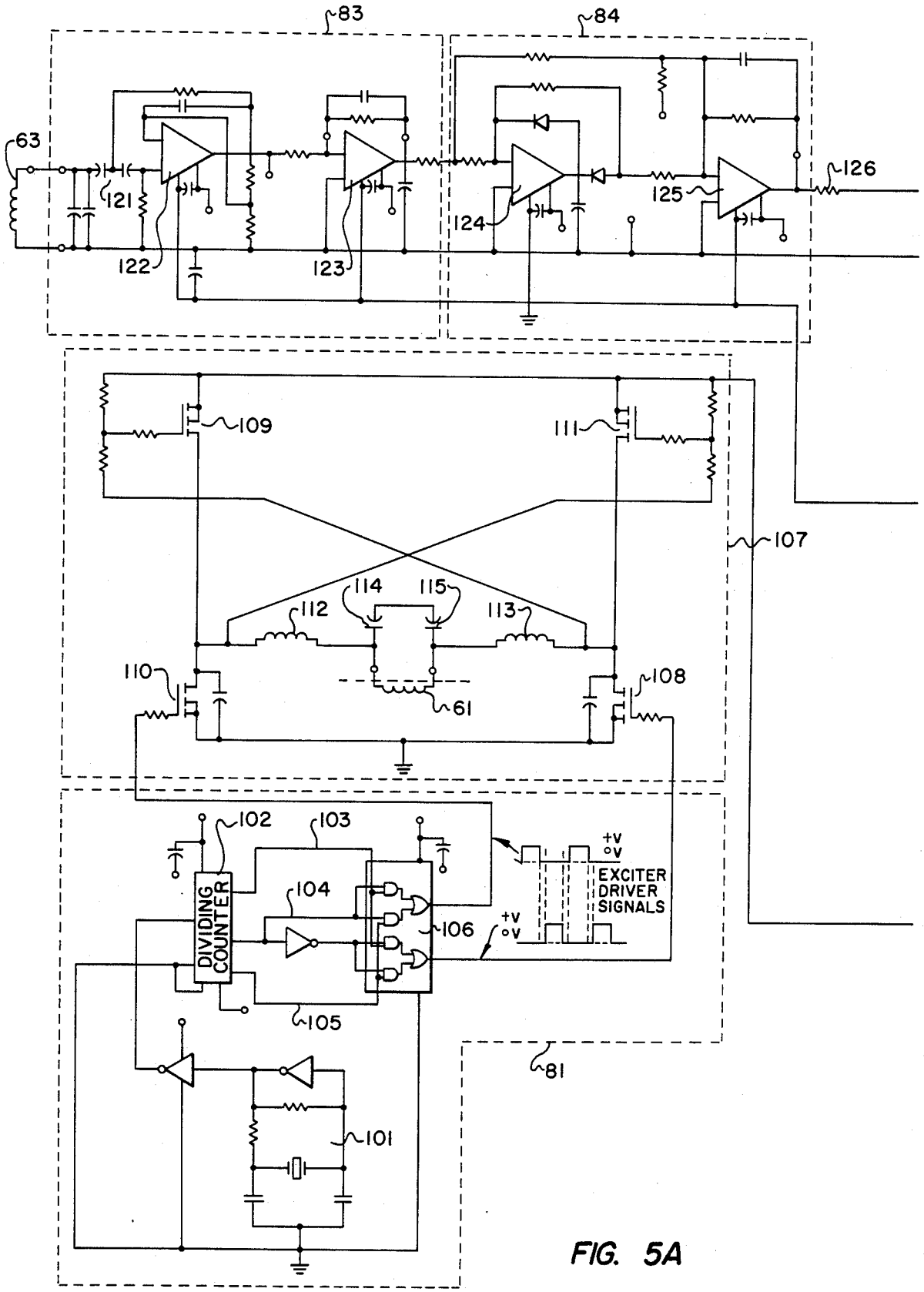
FIGS. 5A and 5B are schematic diagrams of one embodiment of a circuit used in conjunction with the system of the present invention.
Figure 5B:
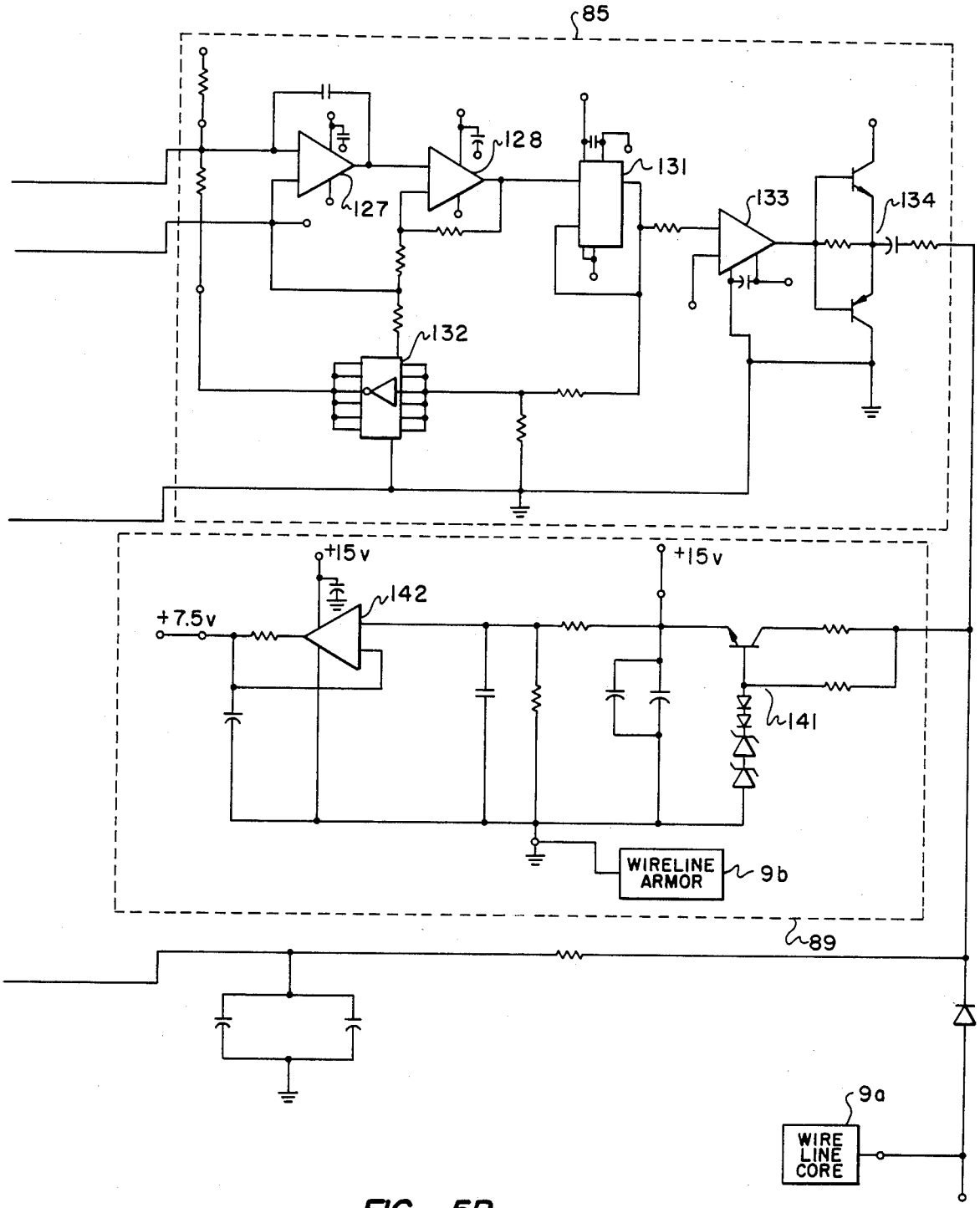

Referring now to FIGS. 5A and 5B, there is shown a schematic diagram of the circuitry shown in FIG. 3. Specifically, the exciter coil 61 is driven by means of an oscillator circuit 81 which comprises a crystal oscillator 101 connected through a dividing counter 102. The crystal 101 operates at a frequency on the order of 1 $MH_z$ and is divided down through counter 102 to output leads 103, 104, and 105, to an AND/OR SELECT gating circuit 106. The AND/OR SELECT gate 106 is of a type such as a CD4019B which provides a suitable drive for a bridge type coil driver circuit 107.

Driver circuit 107 consists of four field effect transistors (FETS) 108, 109, 110, and 111. The FETS 108 and 109 are connected in tandem while FETS 110 and 111 also work in tandem. The AND/OR SELECT gate circuit 106 operates so that FETS 108 and 109 are turned on for a preselected period of time and then off for a preselected finite period of time prior to the turning on of FETS 110 and 111. In this manner, the sensitive transistors 108–110 are protected from the possibility of overloading and damage. The square-wave switching by the FETS is converted to a smooth sinusoidal excitation signal by means of inductance coils 112 and 113 operating through capacitors 114 and 115. The exciter coil 61 is thus driven at a preselected AC frequency by a sinusoidal signal.

Still referring to FIGS. 5A and 5B, the receiver coil 63 is connected to the input of amplifier 83 and by means of capacitors 121 coupled into a first stage amplifier 122 the output of which is connected to a second stage of amplification 123. The output of the second amplifier 123 is coupled into a pair of series connected amplifiers 124 and 125 connected in a peak-to-peak detector configuration. The output of detector 84 is connected through coupling resistor 126 into the voltage to frequency converter 85. The converter 85 comprises an integrator amplifier 127 and a comparator amplifier 128 connected to control the frequency of operation of a pulse generator 131 through a switch 132. The output of the voltage to frequency converter 85 is coupled through an operational amplifier driver 133 and to a line driver 134 which places a series of line voltage pulses onto the wireline 9, for transmission to the surface equipment. The wireline 9 also carries, between the armor 9*b* and the center core conductor 9*a*, a DC voltage which is coupled into a power supply 89 comprising a first voltage regulator 141, which drops the 30 volt input to 15 volt. A second voltage regulator 142 is coupled to regulator 141 for producing a lower power supply voltage of 7.5 volts suitable for driving the operational amplifiers of the present circuitry.

As discussed above, the oscillator 81 serves to drive the exciter coil 61 by means of the bridge driving circuit 107. This produce an AC variation in magnetic flux in exciter coil 63 at a frequency on the order of 128–130 $H_z$. The signal which is induced into the receiving coil 63 is amplified through amplifier 83 and then measured in the peak-to-peak detector 84. The output of the peak-to-peak detector 84 is connected to voltage-to-frequency converter 85 which produces a series of output pulses, the frequency of which is indicative of the input voltage. The output pulses are passed through line driver 134 and back up the wireline 9 to the surface where they are received by the rate meter and recorded.

In operational summary, a first wireline log of the magnetic permeability of the steel walls of the sections of drill pipe 15 is run in the region of the stuck point with all the stress removed from the drill string as described above. Thereafter, the drill string is stressed by the application of force to the drill pipe at the surface by means of longitudinal tension, compression, or rotational torque, and a second log run along the same region of pipe. A comparison of the two logs reveals a sharp variation in magnetic permeability value at the stuck point S due to the differences in stress above and below the stuck point. This variation in permeability shown by comparison of the two logs precisely locates the joint of drill pipe 15A which is stuck in the borehole. An explosive charge carried at the lower end of the tool 10 may then be detonated immediately from the surface while torque is applied to the string and the upper portion of the drill string loosened at that joint. Alternatively, the chemical cutter carried by the lower end of the tool may also be activated to cut the drill string section so that the upper portion thereof can be removed from the borehole.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims:

What is claimed is:

1. A method for detecting the location at which a ferromagnetic pipe string is stuck within a borehole, comprising the steps of:

passing a wireline tool through said pipe string, said wireline tool having disposed thereon a first exciter coil means and longitudinally spaced therefrom a second receiver coil means;

stressing and unstressing said pipe string above said stuck location while said wireline tool is being passed through said pipe string;

measuring a stressed magnetic permeability of the walls of each of two sections of said pipe string while said pipe string is stressed, one section located above and one section located below said stuck location, by inducing first eddy currents in said walls with said first coil means and detecting the electromagnetic field produced by said first eddy currents with said second coil means;

measuring an unstressed magnetic permeability of said walls of each of said sections while said pipe string is unstressed, by inducing second eddy currents in said walls with said first coil means and detecting the electromagnetic field produced by said second eddy currents with said second coil means; and comparing said stressed and unstressed magnetic permeabilities for each said section.

2. The method of claim 1 wherein said inducing comprises the step of producing an alternating frequency signal from said first coil means disposed on a wireline tool.

3. The method of claim 1 further comprising the step of producing a stressed magnetic permeability log and an unstressed magnetic permeability log for a region of said pipe string including said sections.

4. The method of claim 3 wherein said stressed and unstressed logs are produced by the steps of:

while said pipe string is stressed moving a wireline tool through said region and measuring the stressed magnetic permeability of the walls of a plurality of sections within said region;

recording said stressed magnetic permeabilities to produce said stressed magnetic permeability log;

while said pipe string is unstressed moving said wireline tool through said region and measuring the unstressed magnetic permeability of said walls of said plurality of sections; and recording said measured unstressed magnetic permeabilities to produce said unstressed magnetic permeability log.

5. The method of claim 1 wherein said unstressing comprises the step of substantially removing the compressive load applied to said region by the weight of said pipe string above said stuck location.

6. The method of claim 5 wherein said stressing comprises the step of applying a compressive load to said pipe string.

7. The method of claim 6 wherein said stressing comprises the step of applying a torsional load to said pipe string.

8. The method of claim 1 wherein said steps of detecting comprise producing a signal characteristic of the magnitude of said electromagnetic field produced by said eddy currents.

9. The method of claim 2 wherein said steps of detecting comprise producing a signal characteristic of the phase difference between said electromagnetic field produced by said eddy currents and said alternating frequency signal.

10. An apparatus for use in detecting the location at which a ferromagnetic pipe string is stuck within a borehole, comprising:

an elongated housing having means at one end for engaging a wireline and adapted to be lowered through said pipe string into said borehole;

first exciter coil means for inducing eddy currents in the walls of a section of said pipe string, said inducing means disposed on said housing;

second receiver coil means for detecting the magnetic permeability of said section by measuring the electromagnetic field produced by said eddy currents, said detecting means disposed on said housing and spaced longitudinally from said inducing means; and means for comparing two measured magnetic permeabilities of said section wherein one of said permeabilities is measured with said pipe string above said stuck location unstressed and the other of said permeabilities is measured with said pipe string above said stuck location stressed.

11. The apparatus of claim 10 wherein said means for inducing eddy currents comprises a first coil for producing an alternating frequency signal.

12. The apparatus of claim 11 wherein said alternating frequency is about 130 Hz.

13. The apparatus of claim 12 wherein said first and second coils are each disposed about the longitudinal axis of said housing and the longitudinal spacing between said first and second coils is about five to seven inches.

14. The apparatus of claim 10 wherein said detecting means comprises means for producing a signal characteristic of the magnitude of said electromagnetic field produced by said eddy currents.

15. The apparatus of claim 11 wherein said detecting means comprises means for producing a signal characteristic of the phase difference between said electromagnetic field produced by said eddy currents and said alternating frequency signal.

16. A system for detecting the location at which a ferromagnetic pipe string is stuck within a borehole, comprising:

means for measuring the magnetic permeability of a section of said pipe string, comprising, an elongated housing adapted to be lowered on a wireline through said pipe string into said borehole, first exciter coil means for inducing eddy currents in the walls of a section of said pipe string, said inducing means disposed on said housing, second receiver coil means for detecting the electromagnetic field produced by said eddy currents, said detecting means disposed on said housing and spaced longitudinally from said inducing means;

means for stressing said pipe string above said stuck location;

means for unstressing said pipe string above said stuck location; and means for comparing first and second measured magnetic permeabilities of said section wherein said pipe string is unstressed during measurement of said first permeability and is stressed during measurement of said second permeability.

17. The system of claim 16 wherein said means for inducing comprises a first coil for producing an alternating frequency signal and said means for detecting comprises a second coil.

18. The system of claim 17 wherein said alternating frequency is about 130 Hz and the longitudinal spacing between said first and second coils is about five to seven inches.

19. The system of claim 16 further comprising:

means for moving said housing through said borehole so that said first and second measured magnetic permeabilities are determinable at a plurality of known borehole locations; and means for recording first and second magnetic permeability logs of said pipe wherein said pipe string is unstressed during measurement of said first permeability log and is stressed during measurement of said second permeability log.

20. The system of claim 16 wherein said means for stressing comprises means for increasing a compressive load to said pipe string above said stuck location and said means for unstressing comprises means for decreasing said compressive load.

21. The system of claim 20 wherein said means for stressing comprises means for applying a torsional load to said pipe string above said stuck location.

22. The system of claim 16 further comprising means for separating sections of drill pipe within a borehole, said separating means disposed at the end of said housing distal said wireline.

23. The system of claim 31 wherein said means for detecting comprises means for producing a signal characteristic of the magnitude of said electromagnetic field produced by said eddy currents.

24. The system of claim 17 wherein said means for detecting comprises means for producing a signal characteristic of the phase difference between said electromagnetic field produced by said eddy currents and said alternating frequency signal.

* * * * *